US008112927B2

(12) United States Patent
Ruhland et al.

(10) Patent No.: US 8,112,927 B2
(45) Date of Patent: Feb. 14, 2012

(54) CHAMBER LOCK HAVING A PUSHBUTTON FIRING PIN SPRING TENSIONING DEVICE

(75) Inventors: Alfons Ruhland, Kufstein (AT); Michael Obergantschnig, Worgl (AT)

(73) Assignee: VOERE Holding GmbH, Kufstein (AT)

( * ) Notice: Subject to any disclaimer, the term of this patent is extended or adjusted under 35 U.S.C. 154(b) by 254 days.

(21) Appl. No.: 12/597,936

(22) PCT Filed: May 13, 2008

(86) PCT No.: PCT/IB2008/001216

§ 371 (c)(1),
(2), (4) Date: Oct. 28, 2009

(87) PCT Pub. No.: WO2008/142520

PCT Pub. Date: Nov. 27, 2008

(65) Prior Publication Data

US 2010/0088943 A1 Apr. 15, 2010

(30) Foreign Application Priority Data

May 17, 2007 (DE) ..... 20 2007 007 108 U

(51) Int. Cl.
*F41A 3/00* (2006.01)

(52) U.S. Cl. ..... 42/69.02; 89/1.4

(58) Field of Classification Search ..... 42/69.01, 42/69.02; 89/1.4
See application file for complete search history.

(56) References Cited

U.S. PATENT DOCUMENTS

| | | | | |
|---|---|---|---|---|
| 3,603,201 | A | 9/1971 | Aloi et al. | |
| 3,759,519 | A * | 9/1973 | Palma | 473/578 |
| 6,393,961 | B1 * | 5/2002 | Ockenfuss | 89/172 |
| 7,185,454 | B2 * | 3/2007 | Popikow | 42/69.01 |
| 7,617,816 | B1 * | 11/2009 | Orr et al. | 124/31 |
| 7,921,837 | B2 * | 4/2011 | Dobbins et al. | 124/71 |
| 2008/0264399 | A1 * | 10/2008 | Dobbins et al. | 124/71 |

FOREIGN PATENT DOCUMENTS

| | | |
|---|---|---|
| DE | 11 84 244 | 12/1964 |
| EP | 0 243 755 | 11/1987 |
| EP | 0 280 843 | 9/1998 |

* cited by examiner

*Primary Examiner* — Michael Carone
*Assistant Examiner* — Samir Abdosh
(74) *Attorney, Agent, or Firm* — Stites & Harbison PLLC; Douglas E. Jackson

(57) ABSTRACT

The invention relates to a chamber lock (1) for a firearm, having an outer, tubular lock housing (2) and a pushbutton firing pin spring tensioning device (4) provided therein, wherein the pushbutton firing pin spring tensioning device (4) comprises a latching device (6) acting directly or indirectly in the interior of the lock housing (2) positioned between the lock housing (2) on one side and a clamping sleeve (10) for tensioning the firing pin spring (7) on the other side, the latching device being configured such that the firing pin spring (7) can be tensioned in a repeating manner upon pushing the pushbutton (13) of the pushbutton firing pin spring tensioning device (4) once, and subsequently can be maintained in the tensioned state by means of the latching device (6), and that the firing pin spring (7) can be released upon removing the latching effect of the latching device (6) upon a subsequent pushing of the pushbutton (13) of the pushbutton firing pin spring tensioning device (4).

21 Claims, 10 Drawing Sheets

CHAMBER LOCK HAVING A PUSHBUTTON FIRING PIN SPRING TENSIONING DEVICE

The present invention relates to a bolt action for a firearm.

Known from prior art is a bolt action in which the firing spring is actuated by pressing an adapter sleeve in the direction of the muzzle until a latching position on the muzzle side has been reached, wherein a latching rocker provided on the upper side of the bolt action casing latches into the adapter sleeve pushed toward the muzzle in this latching position on the muzzle side.

This known bolt action can be improved:

In the case of this bolt action belonging to prior art, it may be disadvantageous that it requires the use of two fingers on the hand of the marksman or both hands of the marksman to release the firing spring.

To release the firing spring there, a finger or hand must first press the pushbutton toward the muzzle again to cock the firing spring, in particular to relieve the latching rocker there, so as to enable a subsequent, unlatched outward swiveling.

A the same time, the previously relieved latching rocker must be pressed down with another finger of the marksman or with another hand of the marksman, thereby unlatching it from the adapter sleeve.

Only then can the adapter sleeve move back as the firing spring is relieved toward the marksman, thereby securing the firearm.

This known bolt action can also be improved because, in unfavorable cases, relieving the firing pin can be an abrupt, sudden and jolting process.

In particular after unlatching the latching rocker, if the adapter sleeve straining toward the marksman with the entire elastic force of the cocked firing spring is not softly cushioned by the thumb of the marksman, but rather solidly impacts a metal stop on the muzzle side, undesired noise can come about under certain conditions.

The known bolt action can further be improved because latching the latching rocker into the adapter sleeve pushed toward the muzzle and tensioned by the firing spring can sometimes produce a clicking sound, which under certain conditions might scuttle any hunting success by frightening the game to be hunted.

Therefore, the object of the present invention is to provide a bolt action with a firing spring fixture in which only one of the fingers actuating the firing spring fixture or one hand actuating the firing spring fixture need be used to release the cocked firing spring, which is not associated with the danger of a sudden and recoiling release of the firing spring, making it especially valuable from a safety standpoint, and is completely silent and causes no clicking while cocking and releasing the firing spring.

According to the invention, the object is achieved in a generic device by the features indicated hereafter; and especially preferred embodiments are also disclosed hereafter.

Exemplary embodiments of the invention will be described in greater detail based on the drawings. Shown on:

Figure 1:
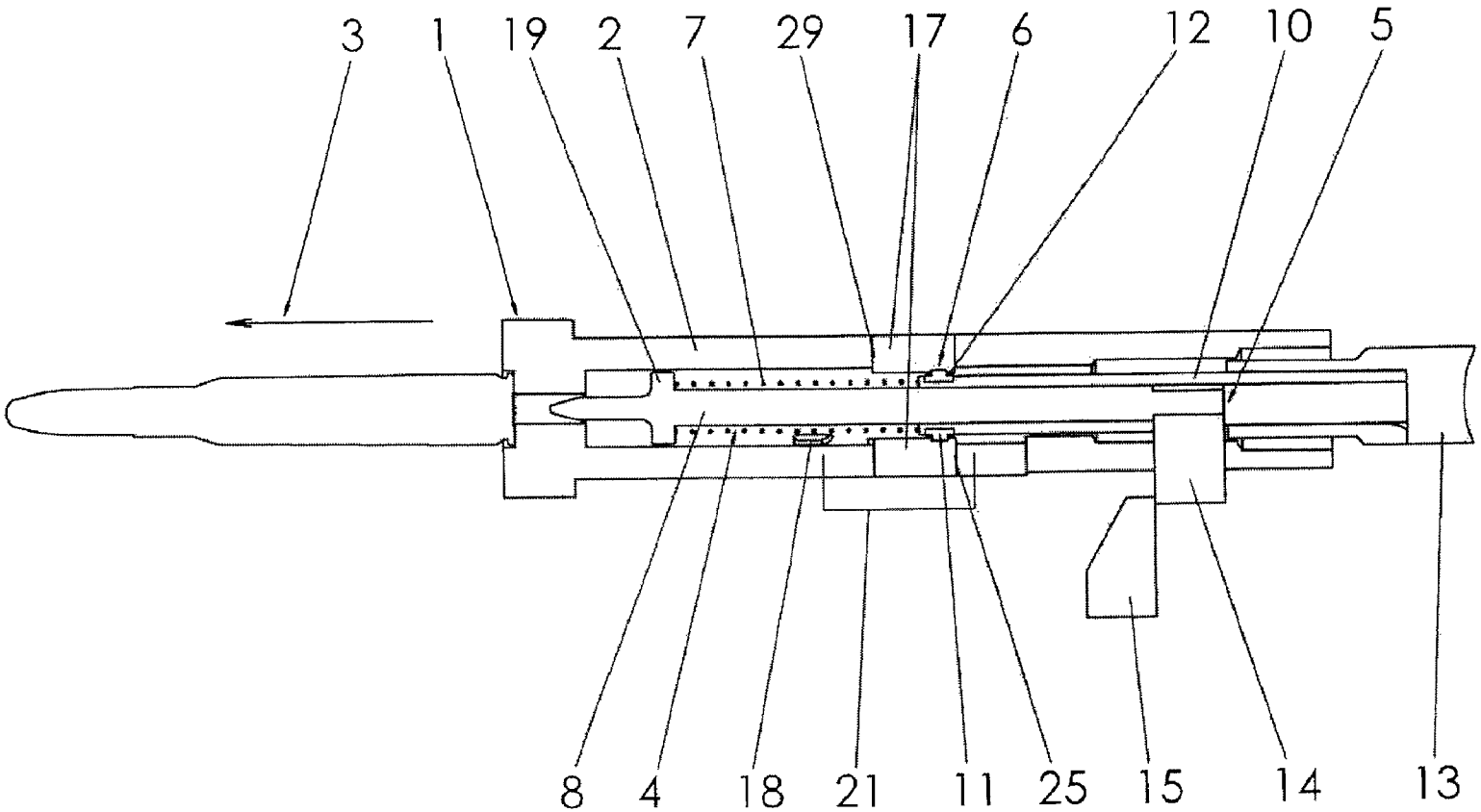
FIG. 1 is a diagrammatic longitudinal section through a bolt action with safety engaged, the firing spring of which is released.

As already evident from FIG. 1, the present invention relates to a bolt action (1) for a firearm, with an outer, tubular action casing (2) and a pushbutton firing spring fixture (4) provided therein.

The pushbutton firing spring fixture (4) preferably encompasses a directly or indirectly acting latching device (6) inside the action casing (2) between the action casing (2) on the one hand and an adapter sleeve (10) for cocking the firing spring (7) on the other.

The latching device (6) of the pushbutton firing spring fixture (4) is preferably designed in such a way that the firing spring (7) can be cocked repeatedly by once pressing the pushbutton (13) resembling a cocking button of the pushbutton firing spring fixture (4).

Figure 2:
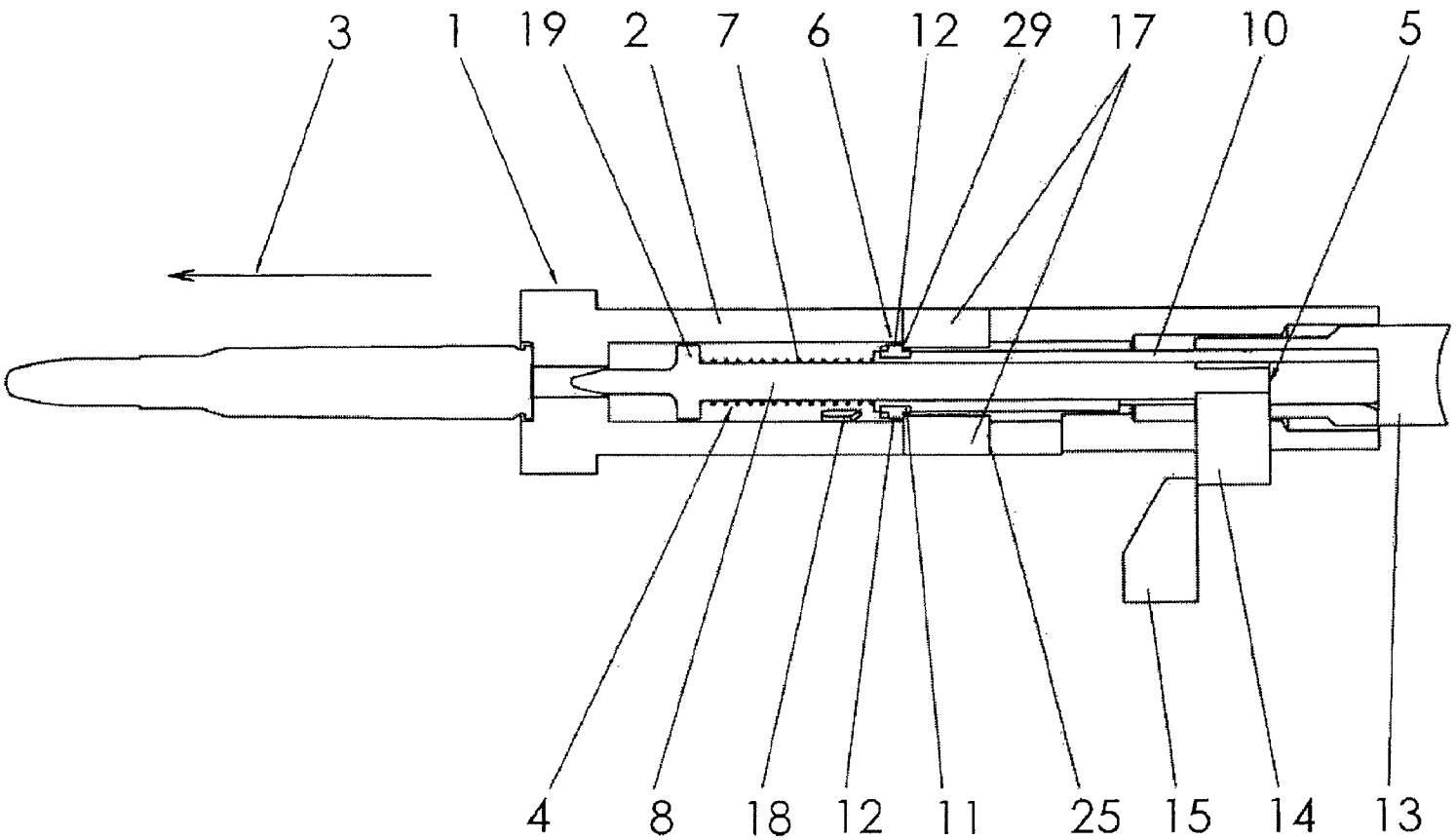
FIG. 2 is a diagrammatic longitudinal section through a bolt action with safety released, the firing spring of which is cocked.

After the firing spring (7) has been cocked, it can be kept cocked by the latching device (6) (see FIG. 2).

When subsequently pressing the pushbutton (13) of the pushbutton firing spring fixture (4), the firing spring (7) can generally be released again as the latching action of the latching device (6) is lifted (see FIG. 1).

Figure 3:
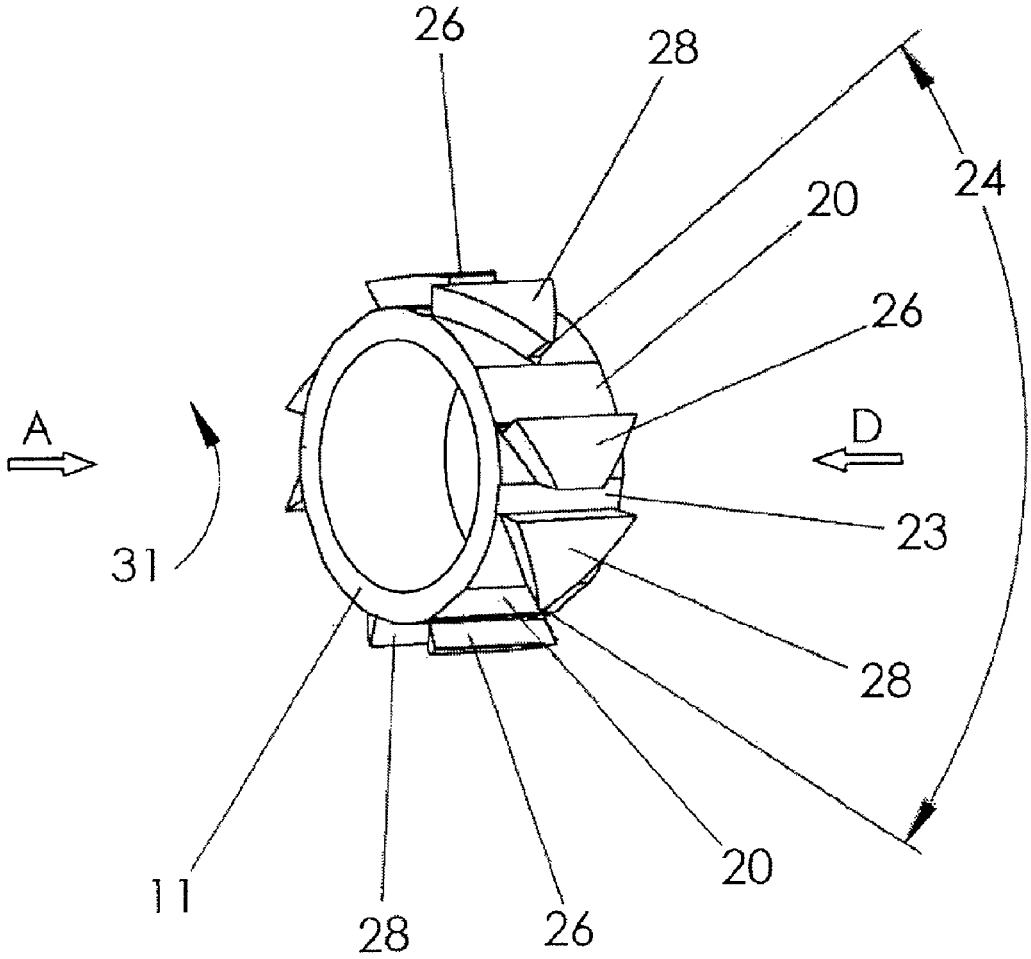
FIG. 3 is a diagrammatic, perspective view of a component of the latching device used according to the invention, specifically a rotatable ring provided on the adapter sleeve with an outer continuous series of control and latching teeth.

As a rule, the latching device (6) on the side of the firing spring (7) of the pushbutton firing spring fixture (4) encompasses a ring (11) rotatably provided on or against an adapter sleeve (10), which as shown on FIG. 3 can exhibit outwardly projecting control and latching teeth (12).

As can be gleaned in particular from FIGS. 1 and 2, as well as FIGS. 8 to 14, the latching device (6) can encompass one or more guiding, latching and rotating blocks (17) that are oblong in longitudinal section on the side of the action casing (2), on the marksman side of the area traversed by the rotatable ring (11) of the adapter sleeve (10) while cocking and releasing the firing spring (7).

In addition to this guiding, latching and rotating block (17) provided on the marksman side of the ring (11), FIGS. 1 and 2 along with FIGS. 8 to 14 also show that one or more control pins (18) can be provided on the action casing side, on the muzzle side of the area (21) traversed by the rotatable ring (11) of the adapter sleeve (10) while cocking and releasing the firing spring (7).

In preferred embodiments, the block(s) (17) and/or the control pins (18) project from the inner wall of the action casing (2) toward the interior of the action casing.

Also in preferred embodiments, the block(s) (17) and/or the control pins (18) can alternately rotate with the control and latching teeth (12) of the ring (11) of the adapter sleeve (10), and interactively latch the ring (11) (see FIGS. 8 to 14).

Figure 11:
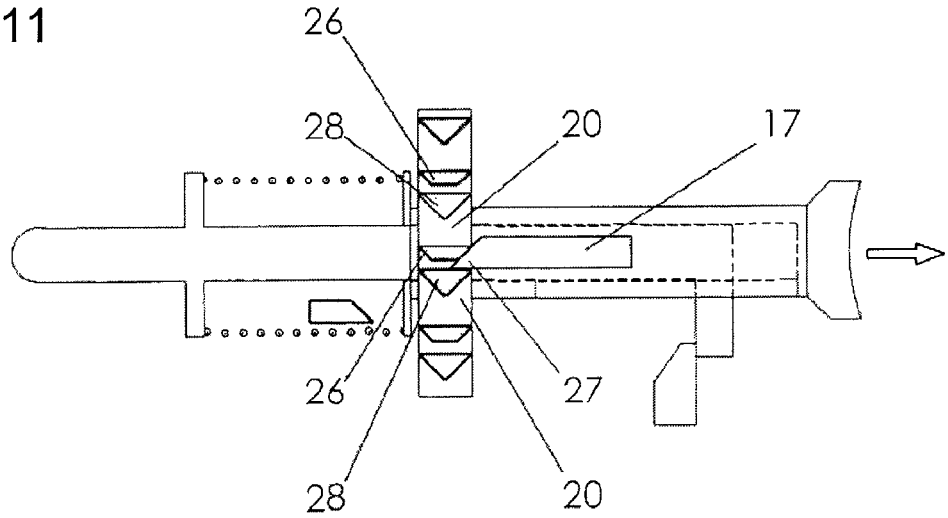
FIG. 11 is a diagrammatic, longitudinal section through a latching device (6) according to the invention, in which a guiding, latching and rotating block on the action casing side of the wheel of the latching device latches and engages with the firing spring cocked.

As evident in particular from FIG. 11, the latching device (6) of the pushbutton firing spring fixture (4) can be designed in such a way that, after releasing the pushbutton (13), once the pushbutton (13) of the pushbutton firing spring fixture (4) has been pressed once for cocking the firing spring (7), the muzzle-side end (29) of the action casing side oblong guiding, latching and rotating block (17) engages into a latching notch (23) introduced on the ring (11), against the force exerted by the cocked firing spring (7).

This latching notch (23) is generally provided on the side of the continuous row of teeth (12) on the ring (11) on the side facing the marksman. As evident from FIG. 11, the ring (11) can turn in a predetermined direction (31) during this latching process, for example.

According to FIG. 11, after latched in the muzzle-side latching tooth (27) of the guiding and latching and rotating block (17) while cocking the firing spring (7), the ring (11) in conjunction with the adapter sleeve (10) secured thereto can be locked in its muzzle-side position along the longitudinal axis (3) of the bolt action (1) by the latching tooth (27) of the guiding and latching and rotating block.

Even with the firing spring cocked in this way, the striking pin (8) can be locked in its marksman-side position until the trigger is actuated, for example by means of a trigger catch (15) that extends into a lug (14) of the striking pin (8).

Figure 12:
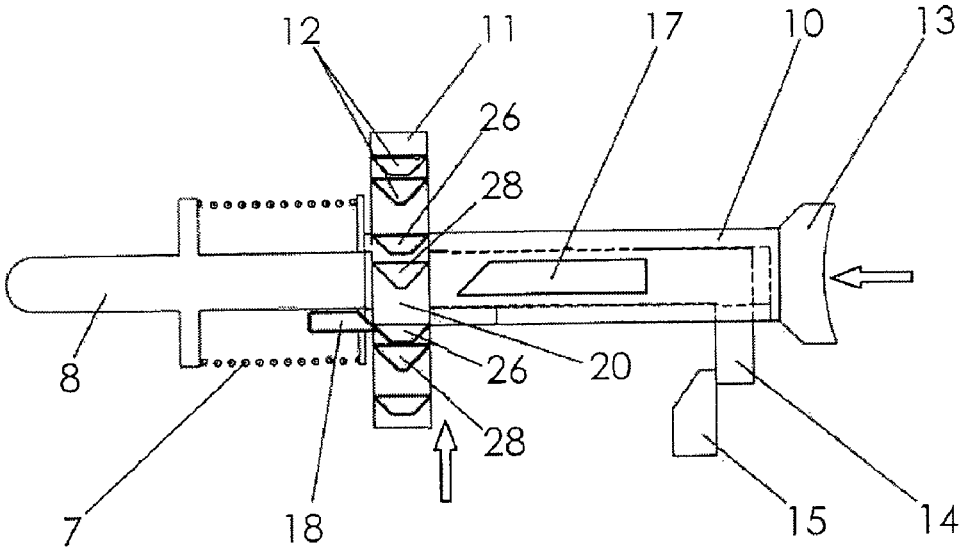
FIG. 12 is a diagrammatic, longitudinal section through a latching device (6) according to the invention, in which the adapter sleeve is again pressed toward the muzzle until the rotatable wheel of the latching device comes into contact with the control pin on the action casing side and toward the muzzle.
Figure 13:
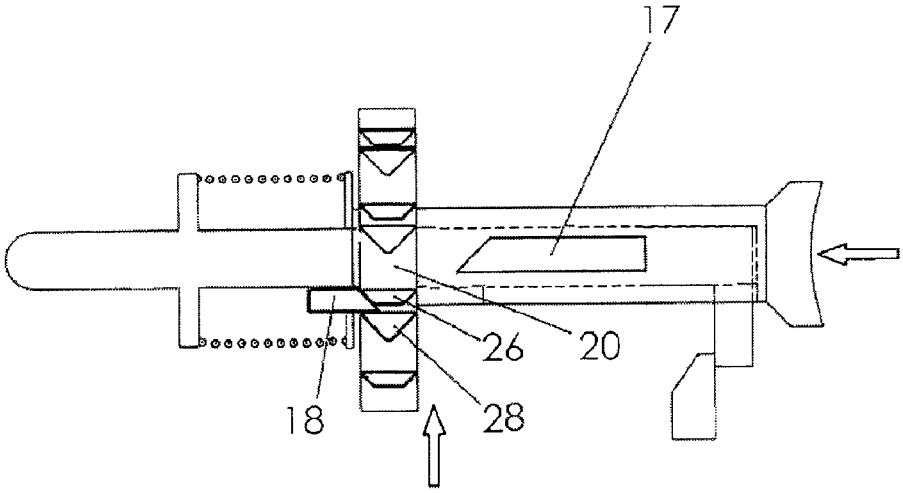
FIG. 13 is a diagrammatic, longitudinal section through a latching device according to the invention, in which the adapter sleeve is pressed against the control pin toward the muzzle until it hits the stop.

As depicted on FIGS. 12 and 13, the latching device (6) of the pushbutton firing spring fixture (4) can be designed in such a way that, if the pushbutton (13) of the pushbutton firing spring fixture (4) is pressed after the latching step, the latching notch (23) between the teeth (12) of the ring (11) can be lifted off of the muzzle-side end (29) of the action casing-side, oblong guiding, latching and rotating block (17).

As also evident from FIGS. 12 and 13, the latching device (6) of the pushbutton firing spring fixture (4) can be designed in such a way that, if the pushbutton (13) of the pushbutton firing spring fixture (4) is pressed after the latching step, it is possible to continue turning the ring (11) in the same predetermined direction (31) by having its teeth (12) moving toward the muzzle hit the action casing-side control pins (18) toward the muzzle.

In particular FIG. 13 shows that the latching device (6) of the pushbutton firing spring fixture (4) can be designed in such a way that, if the pushbutton (13) of the pushbutton firing spring fixture (4) is pressed after the latching step, the ring (11) of the latching device (6) of the pushbutton firing spring fixture (4) can be further turned in the rotational direction (31) until a through hole (20) between the teeth (12) comes to rest flush on the ring (11) in front of the muzzle-side end (29) of the action casing-side, oblong guiding, latching and rotating block (17).

Figure 14:
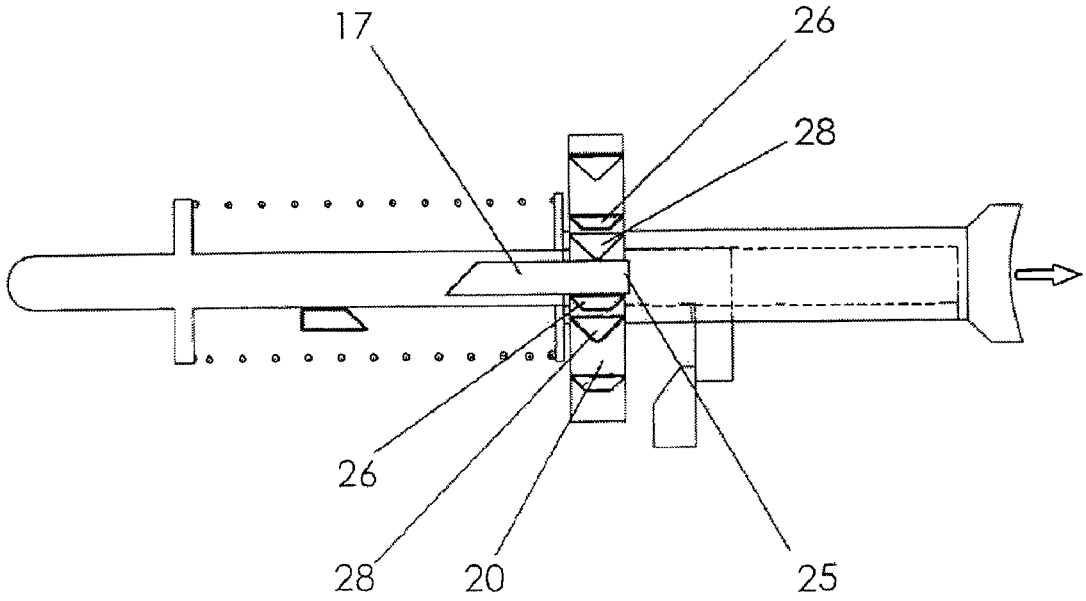
FIG. 14 is a diagrammatic, longitudinal section through a latching device (6) according to the invention, in which the adapter sleeve is moved toward the marksman while releasing the firing spring, wherein the wheel of the latching device glides toward the marksman along a guiding, latching and rotating block on the marksman and action casing side.

As depicted on FIG. 14, the latching device (6) of the pushbutton firing spring fixture (4) can further be designed in such a way that one of its through holes (20) of the ring (11) can be used to shift it in the direction of the marksman-side end (25) of the guiding, latching and rotating block (17) toward the marksman by pressing the firing spring (7), guided along the flanks of the action casing-side guiding, latching and rotating block (17).

In this case, the release of the firing spring (7) is accompanied by a shifting of the adapter sleeve (10) and pushbutton (13) connected thereto in the direction of the marksman.

Even during this release of the firing spring (7), the firing pin (8) can usually be locked in its original marksman-side initial position by means of a trigger catch (15).

As evident in particular from FIGS. 1 and 2, the pushbutton firing spring fixture (4) encompasses a firing pin (8) that extends along the longitudinal axis (3) of the bolt action (1) in especially preferred embodiments of the bolt action according to the invention.

This firing pin (8) can exhibit a firing pin lug (14) for locking the firing pin (8) along the longitudinal axis (3) in a marksman-side initial position while cocking and releasing the firing spring (7) by latching in a trigger catch (15).

As a rule, the muzzle-side section of the firing pin (8) is spirally encompassed by a firing spring (7).

A support (19) or collar-shaped projection can be provided in the section of the firing pin (8) situated toward the muzzle to provide a muzzle-side stop for the firing spring (7).

To provide a direct or indirect marksman-side stop for the firing spring (7), an adapter sleeve (10) can encompass the marksman-side section of the firing pin (8) as a sleeve along the longitudinal axis (3) of the bolt action (1) in such a way that it can slide back and forth, for purposes of cocking or releasing the firing spring (7).

In particular FIGS. 1 and 2 show that the marksman-side end of the adapter sleeve (10) can carry a pushbutton (13) designed as a grip head, for example, to support a marksman finger.

This pushbutton (13) can project out of the action casing (2) in the direction of the marksman with the firing spring (7) released.

According to FIGS. 8 to 14, the surface of the adapter sleeve (10) can be provided with a rotatably mounted ring (11), for example.

As depicted on FIG. 3, this ring (11) can exhibit outwardly projecting control and latching teeth (12) to alternately latch and unlatch while interacting with one or more guiding, latching and rotating blocks (17) provided on the interior of the action casing (2) and with one or more control pins (18) provided on the interior of the action casing (2).

As evident in particular from FIGS. 3 to 7, two or more units (24) can be provided one after the other on the outer circumference of the ring (11) in the rotational direction (31) of the ring (11).

In especially preferred embodiments of the bolt action (1) according to the invention, each unit (24) tallied in the rotational direction (31) can encompass initially a through or guide hole (20) for the action casing-side, longitudinally oblong guiding, latching and rotating block (17), a first control tooth (26) adjacent to the ring (11) in its rotational direction (31), and a control tooth (26) adjacent hereto in the rotational direction (31), and a latching notch (23) adjacent hereto in the rotational direction (31) for the muzzle-side end (29) of the guiding, latching and rotating block (17), and a second control tooth (28) adjacent hereto in the rotational direction (31).

For example, the traversed movement path (21) of the ring (11) along the longitudinal axis (3) of the bolt action (1) depicted in particular on FIG. 1 as the firing spring (7) is cocked and released can range from 4.0 mm to 40.00 mm, in particular from 5.0 mm to 30.0 mm.

According to FIGS. 1 and 14, when the firing spring (7) is released, the marksman-side end (25) of the action casing-side, longitudinally oblong guiding, latching and rotating block (17) can be located in a through hole (20) in the row of control and latching teeth (12) continuously provided on the outer periphery of the rotatable ring (11).

Figure 6:
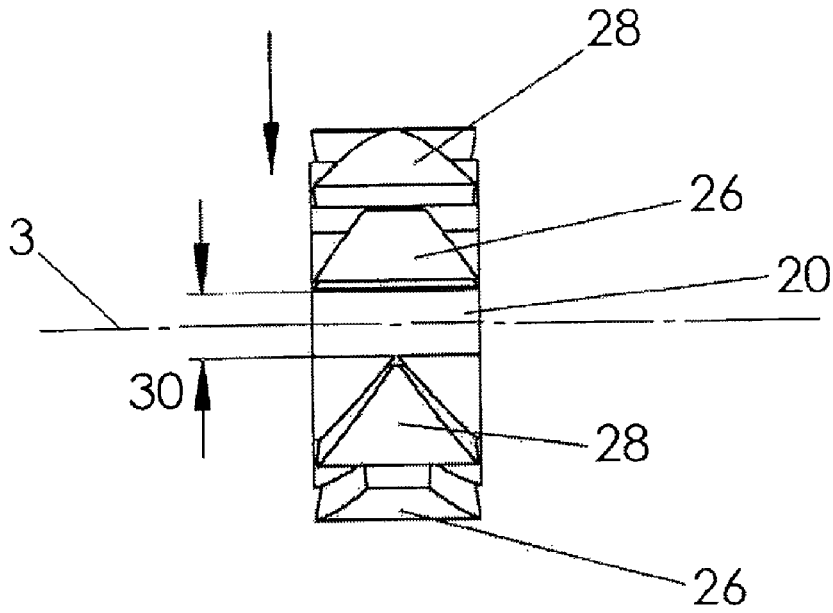
FIG. 6 is a diagrammatic, perspective, side view of the rotatable ring of the adapter sleeve shown in perspective on FIG. 3, viewed from the direction of the arrow B on FIG. 4.

The width (30) of the through holes (20) of the row of control and latching teeth (12) continuously provided on the outer circumference of the rotatable ring (11) as shown in particular on FIG. 6 can range from 3.0 mm to 25.0 mm, preferably from 3.5 mm to 20.0 mm, in particular from 4.0 mm to 15.0 mm, for example.

Figure 7:
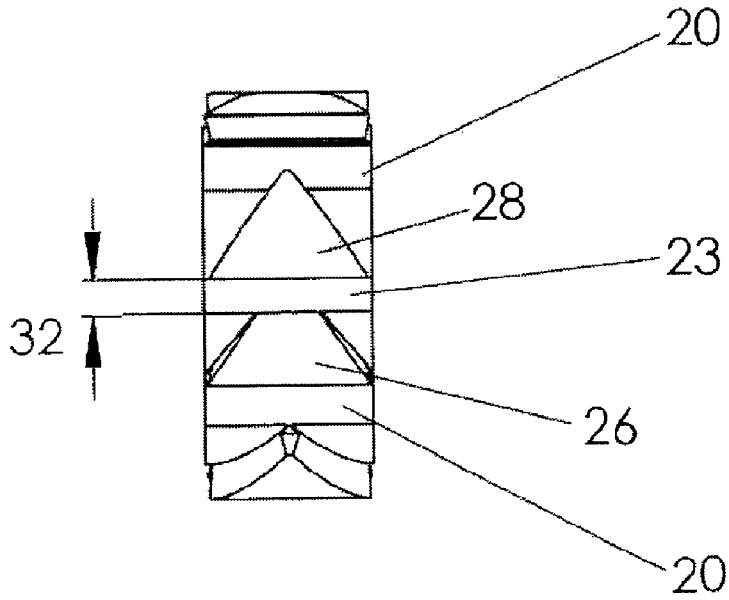
FIG. 7 is a diagrammatic, perspective, side view of the rotatable ring of the adapter sleeve shown in perspective on FIG. 3, viewed from the direction of the arrow C on FIG. 4.

The width (32) of the latching notches (23) shown in particular on FIG. 7 can range from 0.5 mm to 3.4 mm, preferably from 0.6 mm to 3.0 mm, in particular from 0.7 mm to 2.8 mm.

The kinetics of the latching device (6) of a specific, especially preferred exemplary embodiment of the bolt action (1) will be described in greater detail below drawing reference to FIGS. 8 to 14.

Figure 8:
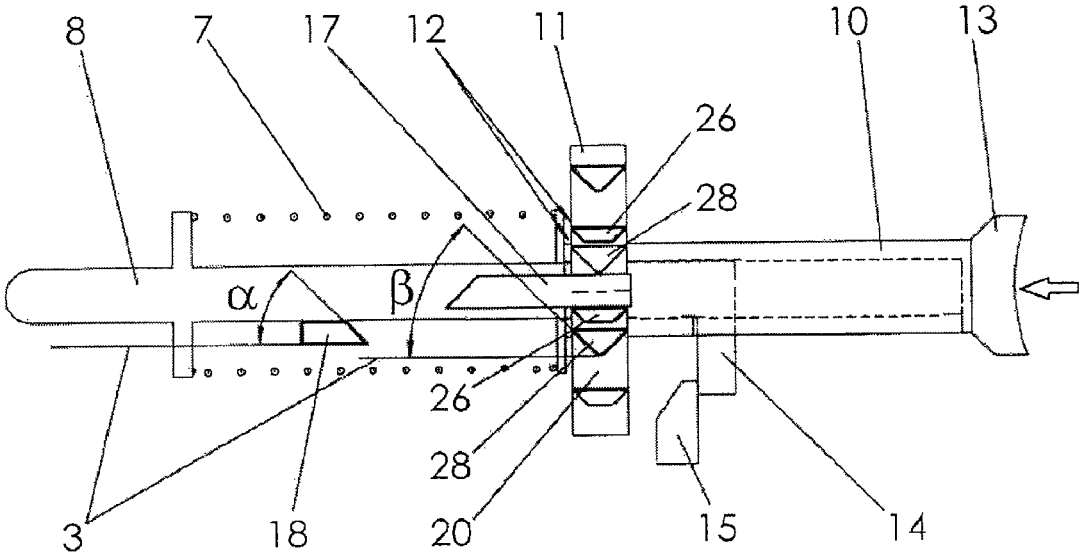
FIG. 8 is a diagrammatic, longitudinal section through a latching device (6) according to the invention in the initial position, in which the firing spring is still completely released, and the adapter sleeve still projects out of the bolt action on the marksman side.

According to FIG. 8, the latching device (6) of the pushbutton firing spring fixture (4) can be designed in such a way that, when first pressing the pushbutton (13) resembling a cocking button of the pushbutton firing spring fixture (4), a through hole (20) between the control and latching teeth (12) of the rotatable ring (11) initially glides along the action casing-side, oblong guiding, latching and rotating block (17) to cock the firing spring (7).

Figure 9:
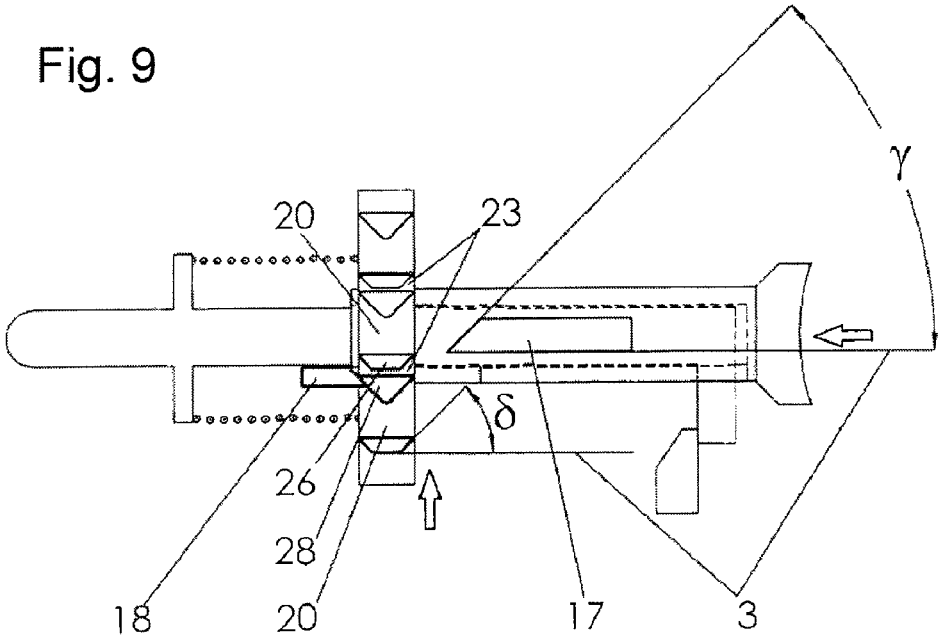
FIG. 9 is a diagrammatic, longitudinal section through a latching device (6) according to the invention, in which the adapter sleeve tensioned by the firing spring is pressed toward the muzzle until the very point where rotatable wheel of the latching device comes into contact with the control pin toward the muzzle on the action casing side.
Figure 10:
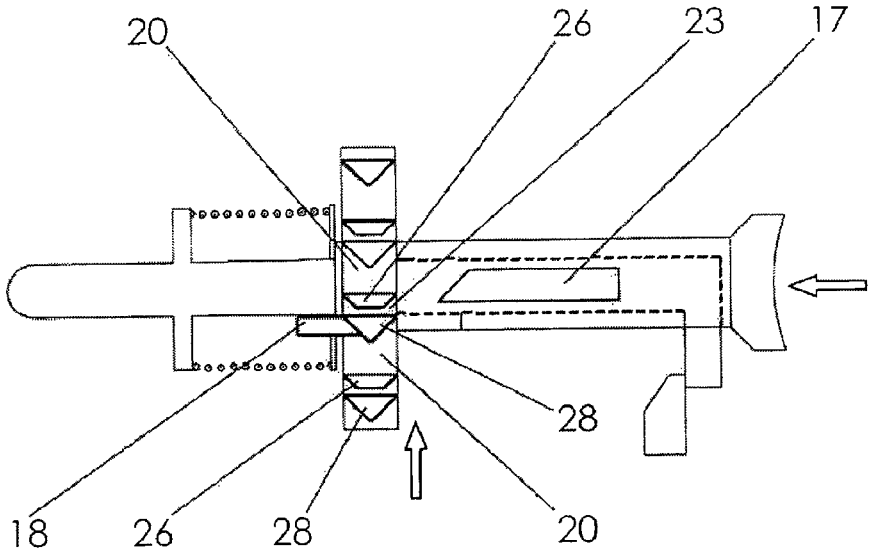
FIG. 10 is a diagrammatic, longitudinal section through a latching device (6) according to the invention, in which the adapter sleeve is pressed toward the muzzle until it hits the stop.

According to FIG. 9, the latching device (6) of the pushbutton firing spring fixture (4) can further be designed in such a way that the through hole (20) then becomes clear of the muzzle-side end (29) of the oblong guiding, latching and rotating block (17) in the direction of the muzzle.

According to FIG. 9, the latching device (6) of the pushbutton firing spring fixture (4) can further be designed in such a way that the muzzle-side contact surface of a second control tooth (28) adjacent to the first control and latching tooth (26) then hits the muzzle-side contact surface of an action casing-side control pin (18) toward the muzzle.

As may be gleaned in particular from FIG. 8, the muzzle-side contact surface of the second control tooth (28) of the ring (11) on the one hand and the marksman-side contact surface of the control pin (18) of the action casing (2) on the other are or can preferably be aligned to correspond to each other at an angle in such a way that the ring (11) undergoes segmental rotation in a prescribed rotational direction (31) once these contact surfaces come into contact.

This first segmental rotation of the ring (11) preferably takes place to such an extent that a marksman-side latching notch (23) formed in the continuous row of latching and control teeth (12) comes to lie between a first control and latching tooth (26) and a second control and latching tooth (28) adjacent hereto, aligned flush and engageable relative to the latching tooth (27) of the muzzle-side end (29) of the action casing-side guiding, latching and rotating block9 (17).

As evident from FIG. 11, the latching device (6) of the pushbutton firing spring fixture (4) can be designed in such a way that, when the pushbutton (13) of the pushbutton firing spring fixture (4) is first released, in the time after it has been pressed up until hitting the stop for purposes of cocking the firing spring (7), the marksman-side contact surface of a first in the rotational direction (31) control and latching tooth (26) of the wheel (11) provided in front of a second control and latching tooth (28) in the rotational direction (31) comes to engage and latch the muzzle-side contact surface of the latching tooth (27) of the action casing-side end (29) toward the muzzle of the oblong guiding, latching and rotating block (17), and the lateral flank of the second control tooth (28).

As evident from FIG. 12, the latching device (6) of the pushbutton firing spring fixture (4) can be designed in such a way that, when the pushbutton (13) of the pushbutton firing spring fixture (4) is subsequently pressed again until it hits the stop, the muzzle-side contact surface of the first control and latching tooth (26) of a unit (24) that follows in the rotational direction (31) can be brought into contact with the marksman-side contact surface of the action casing-side control pin (18).

As evident in particular from FIGS. 12 and 13, these contact surfaces can be aligned or designed at an angle relative to each other in such a way that the ring (11) continues to undergo a segmental turn in the previous rotational direction (31) until the through hole (20) that follows in the rotational direction (31) comes to lie flush in the extension of the action casing-side guiding, latching and rotating block (17) (see in particular FIG. 13).

As evident from FIG. 14, the latching device (6) of the pushbutton firing spring fixture (4) can be designed in such a way that, when the pressure exerted on the pushbutton (13) of the pushbutton firing spring fixture (4) is subsequently released, the muzzle-side end (29) of the action casing-side guiding, latching and rotating block (17) engages into the through hole (20) on the ring (11) aligned flush in front of it, and the ring (11) can be returned to the marksman-side end (25) of the guiding, latching and rotating block (17) while releasing the firing spring (7).

In particular FIG. 8 shows that the beveled, marksman-side contact surface of the action casing-side control pin (18) can include an angle $\alpha$ with the longitudinal axis (3) of the bolt action (1) when viewed from above, for example ranging from 15° to 70°, preferably from 20° to 60°, and particularly from 30° to 50°.

Also evident from FIG. 8 is that the muzzle-side contact surfaces of the first control tooth (26) and the second control tooth (28) of each unit (24) can include an angle $\beta$ with the longitudinal axis (3) of the bolt action (1) when viewed from above that corresponds to angle $\alpha$, for example, and also ranges from 15° to 70°, preferably from 20° to 60°, in particular from 30° to 50°.

As evident in particular from FIG. 9, the inclined contact surface of the muzzle-side latching tooth (27) of the muzzle-side end (29) of the guiding, latching and rotating block (17) can include an angle $\gamma$ with the longitudinal axis (3) of the bolt action (1) when viewed from above that ranges from 15° to 70°, preferably from 20° to 60°, in particular from 30° to 50°.

FIG. 9 also shows that the marksman-side contact surfaces of the first control tooth (26) and second control tooth (28) of each unit (24) can include an angle $\delta$ with the longitudinal axis (3) of the bolt action (1) when viewed from above that preferably corresponds to the γ angle, and also ranges from 15° to 70°, preferably from 20° to 60°, in particular from 30° to 50°.

As evident in particular from FIG. 3, the first control tooth (26) of each unit (24) can exhibit a shape that resembles a trapezoid or equilateral trapezoid when viewed from above.

As a rule, the base line of the trapezoid is aligned parallel to the longitudinal axis (3) of the bolt action (1).

In general, the parallel side of the trapezoid opposite the base line is shorter than the base line.

In particular according to FIG. 3, the second control tooth (28) of each unit (24) can exhibit a triangular surface area when viewed from above, wherein the hypotenuse of the triangle or its largest side is preferably aligned parallel to the longitudinal axis (3) of the bolt action (1).

Figure 4:
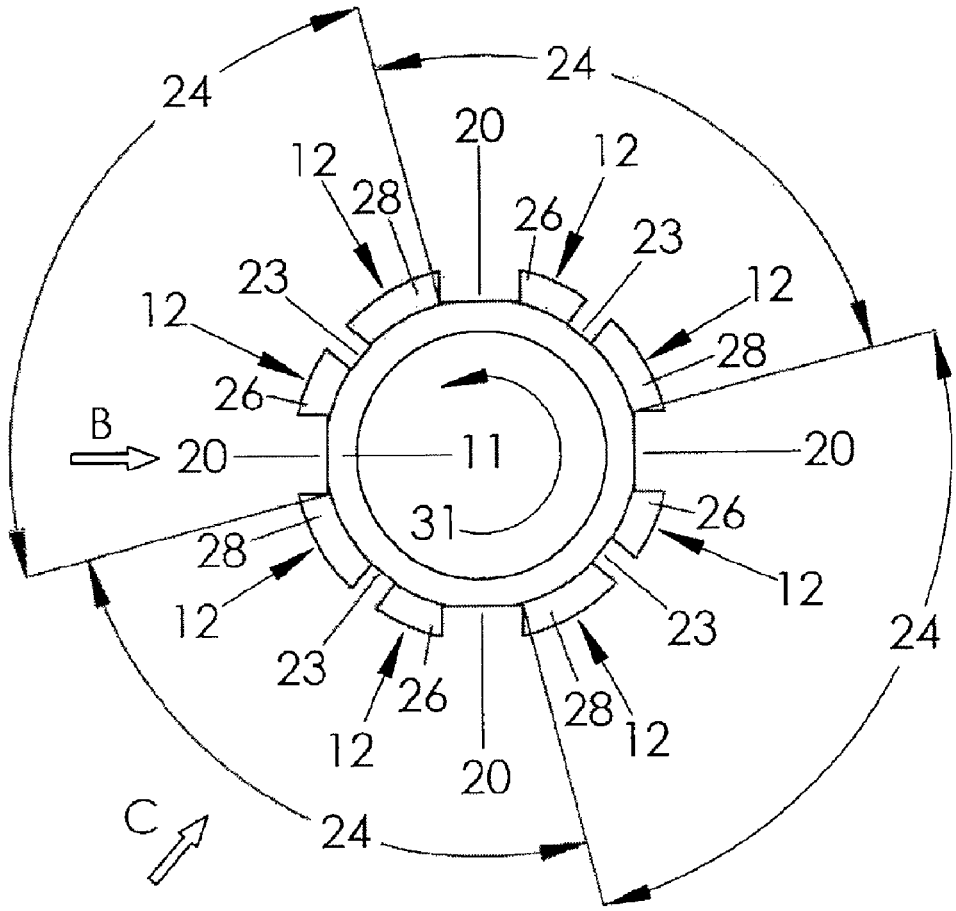
FIG. 4 is a diagrammatic, muzzle-side view of the rotatable ring of the adapter sleeve shown in perspective on FIG. 3, viewed from the direction of the arrow A on FIG. 3.
Figure 5:
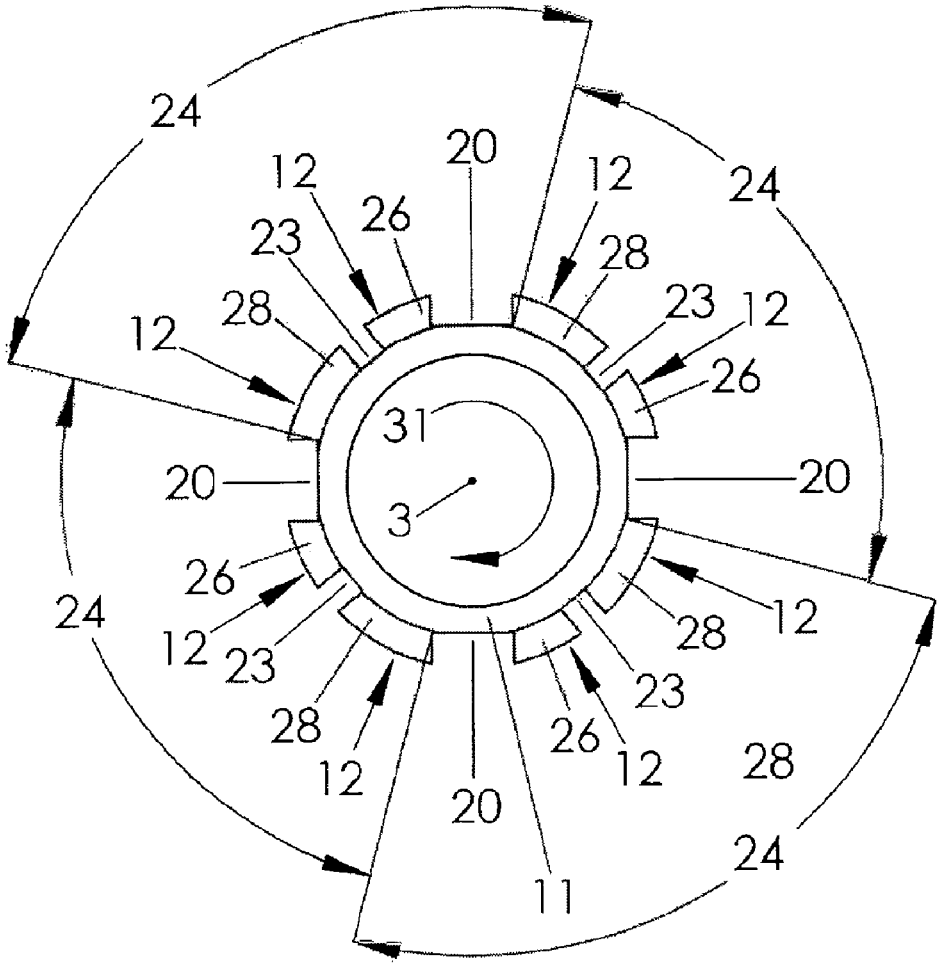
FIG. 5 is a diagrammatic, marksman-side view of the rotatable ring of the adapter sleeve shown in perspective on FIG. 3, viewed from the direction of the arrow B on FIG. 4.

As particularly evident from FIGS. 3 to 5, the contact surfaces of the first control tooth (26) and second control tooth (28) along with the lateral borders of the through holes (20), in an effort to reduce the respective frictional surfaces, can be outwardly projecting and back-cut with respect to their interior surface area on the outer periphery of the ring (11) when viewed along the longitudinal axis (3) of the bolt action (1).

The contact surfaces of the first control tooth (26) and second control tooth (28) can be straight or exhibit convex or concavely bent contours when viewed from above (see in particular FIG. 3).

In summation, it can be stated that, within the framework of the present invention, a bolt action with a pushbutton firing spring fixture is provided, the pushbutton firing pin fixture of which can be operated with one finger or hand, and consequently makes it possible to use only one of the fingers actuating the pushbutton firing spring fixture or a hand actuating the pushbutton firing spring fixture to cock or release the firing spring.

For the first time, an additional finger or the second hand need not be used for releasing and swiveling out a latching rocker in the bolt action according to the invention.

Also advantageous in the case of the bolt action according to the invention is that it does not involve the danger of a sudden and jolting release of the firing spring, making it particularly advantageous from a safety standpoint.

Another very important advantage of the bolt action according to the invention has to do with the fact that it does not cause any clicking while cocking the firing spring, but rather can be operated in complete silence. The same holds true for the process of releasing the firing spring.

This eliminates the concern that game will be unintentionally frightened while cocking or releasing the firing spring in the bolt action according to the invention.

The invention claimed is:

1. Bolt action for a firearm, comprising:

an outer, tubular action casing; and a pushbutton firing spring fixture provided the action casing, wherein the pushbutton firing spring fixture encompasses a directly or indirectly acting latching device inside the action casing and between the action casing and an adapter sleeve which cocks a firing spring, where the latching device is designed in such a way that the firing spring can be cocked repeatedly by once pressing a pushbutton of the pushbutton firing spring fixture, after which the firing spring can be kept cocked by the latching device and, when subsequently pressing the pushbutton of the pushbutton firing spring fixture, the firing spring can be released again as the latching action of the latching device is lifted.

2. The bolt action according to claim 1, wherein the latching device on a side of the firing spring of the pushbutton firing spring fixture encompasses a ring rotatably provided on or against the adapter sleeve, wherein the ring exhibits outwardly projecting control and latching teeth, and wherein the latching device encompasses one or more guiding, latching and rotating blocks that are oblong in longitudinal section on the side of the action casing, on the marksman side of the area traversed by the rotatable ring of the adapter sleeve while cocking and releasing the firing spring, and one or more control pins on the muzzle side of the area traversed by the rotatable ring of the adapter sleeve while cocking and releasing the firing spring, and wherein one of the guiding, latching and rotating blocks or the control pins project inwardly from the inner wall of the action casing, and with the control and latching teeth of the ring of the adapter sleeve alternately rotate the ring and interactively latch the ring.

3. The bolt action according to claim 2, wherein the latching device of the pushbutton firing spring fixture is designed in such a way that, after releasing the pushbutton, once the pushbutton of the pushbutton firing spring fixture has been pressed once for cocking the firing spring, the muzzle-side end of the action casing side oblong guiding, latching and rotating block engages into a latching notch introduced on the ring, against the force exerted by the cocked firing spring, which is provided on the side of the continuous row of teeth on the ring on the side facing the marksman, wherein the ring turns in a predetermined direction during this latching process, and wherein the ring in conjunction with the adapter sleeve secured thereto can be locked in a muzzle-side position thereof along the longitudinal axis of the bolt action after latching while cocking the firing spring, and wherein the striking pin can be locked in a marksman-side position thereof by a trigger catch that extends into a lug of the striking pin.

4. The bolt action according to claim 3, wherein the latching device of the pushbutton firing spring fixture is designed in such a way that, if the pushbutton of the pushbutton firing spring fixture is pressed after the latching step, the latching notch between the teeth of the ring can be lifted off of the muzzle-side end of the action casing-side, oblong guiding, latching and rotating block, and the ring can continue to be turned in the same predetermined direction by having the teeth thereof moving toward the muzzle hit the action casing-side control pins toward the muzzle, until a through hole between the teeth comes to rest flush on the ring in front of the muzzle-side end of the action casing-side, oblong guiding, latching and rotating block, and that one of the through holes thereof can be used to subsequently further shift the ring in the direction of the marksman-side end of the guiding, latching and rotating block toward the marksman by pressing the firing spring, guided along the flanks of the action casing-side guiding, latching and rotating block, and with the release of the firing spring and while shifting the adapter sleeve in the direction of the marksman, wherein the firing pin can be locked in an original marksman-side initial position thereof by a trigger catch.

5. The bolt action according to claim 1, wherein the pushbutton firing spring fixture encompasses a firing pin extending along the longitudinal axis, which has a firing pin lug for locking the firing pin along the longitudinal axis of the bolt action in a marksman-side initial position while cocking and releasing the firing spring by latching in a trigger catch and a muzzle-side section thereof is spirally encompassed by a firing spring, wherein a support or collar-shaped projection is provided in the section of the firing pin situated toward the muzzle to provide a muzzle-side stop for the firing spring, and wherein, to provide a direct or indirect marksman-side stop for the firing spring, the adapter sleeve encompasses the marksman-side section of the firing pin as a sleeve along the longitudinal axis in such a way that the sleeve can slide back and forth, for purposes of cocking or releasing the firing spring, wherein the marksman-side end of the adapter sleeve, to support a marksman finger, carries a pushbutton designed as a grip head, which projects out of the action casing in the direction of the marksman with the firing spring released, and wherein the surface of the adapter sleeve is provided with a rotatably mounted ring, which exhibits outwardly projecting control and latching teeth to alternately latch and unlatch while interacting with one or more guiding, latching and rotating blocks provided on the interior of the action casing and with one or more control pins provided on the interior of the action casing.

6. The bolt action according to claim 2, wherein two or more units are provided one after the other on the outer circumference of the ring in the rotational direction of the ring, wherein each unit encompasses initially a through or guide hole for the action casing-side, longitudinally oblong guiding, latching and rotating block, a first control tooth subsequent to the ring in a rotational direction thereof, and a latching notch subsequent hereto in the rotational direction for the muzzle-side end of the guiding, latching and rotating block, and a second control tooth subsequent hereto in the rotational direction.

7. The bolt action according to claim 2, wherein the traversed movement path of the ring along the longitudinal axis while cocking and releasing the firing spring ranges from 3.0 mm to 50.0 mm, and that, when the firing spring is released, the marksman-side end of the action casing-side, longitudinally oblong guiding, latching and rotating block is located in a through hole in the row of control and latching teeth continuously provided on the outer periphery of the rotatable ring.

8. The bolt action according to claim 1, wherein the width of the through holes of the row of control and latching teeth continuously provided on the outer circumference of the rotatable ring ranges from 3.0 mm to 25.0 mm, while the width of the latching notches ranges from 0.5 mm to 3.4 mm.

9. The bolt action according to claim 2, wherein the latching device of the pushbutton firing spring fixture is designed in such a way that, when first pressing the pushbutton of the pushbutton firing spring fixture, a through hole between the control and latching teeth of the rotatable ring initially glides along the action casing-side, oblong guiding, latching and rotating block to cock the firing spring, after which the through hole becomes clear of the muzzle-side end of the oblong guiding, latching and rotating block in the direction of the muzzle, and subsequently the muzzle-side contact surface of a second control tooth adjacent to the first control and latching tooth then hits the muzzle-side contact surface of an action casing-side control pin toward the muzzle, wherein the muzzle-side contact surface of the second control tooth and the marksman-side contact surface of the control pin are aligned or designed to correspond to each other at an angle in such a way that the ring undergoes segmental rotation in a prescribed rotational direction once these contact surfaces come into contact, that a marksman-side latching notch formed in the continuous row of latching and control teeth comes to lie between a first control and latching tooth and a second control and latching tooth adjacent hereto, aligned flush and engageable relative to the latching tooth of the muzzle-side end of the action casing-side guiding, latching and rotating block.

10. The bolt action according to claim 9, wherein the latching device of the pushbutton firing spring fixture is designed in such a way that, when the pushbutton of the pushbutton firing spring fixture is first released, in the time after the pushbutton has been pressed up until hitting a stop for purposes of cocking the firing spring, the marksman-side contact surface of a first control and latching tooth of the ring provided in front of a second control and latching tooth in the rotational direction comes to engage and latch the muzzle-side contact surface of the latching tooth of the action casing-side end toward the muzzle of the oblong guiding, latching and rotating block, and the lateral flank of the second control tooth.

11. The bolt action according to claim 10, wherein the latching device of the pushbutton firing spring fixture is designed in such a way that, when the pushbutton of the pushbutton firing spring fixture is subsequently pressed again until it hits the stop, the muzzle-side contact surface of the first control and latching tooth of a unit that follows in the rotational direction can be brought into contact with the marksman-side contact surface of the action casing-side control pin, wherein these contact surfaces are aligned or designed at an angle relative to each other in such a way that the ring continues to undergo a segmental turn in the previous rotational direction until the through hole that follows in the rotational direction comes to lie flush in the extension of the action casing-side guiding, latching and rotating block.

12. The bolt action according to claim 11, wherein the latching device of the pushbutton firing spring fixture is designed in such a way that, when the pressure exerted on the pushbutton of the pushbutton firing spring fixture is subsequently released, the muzzle-side end of the action casing-side guiding, latching and rotating block engages into the through hole on the ring aligned flush in front thereof, and the ring can be returned to the marksman-side end of the guiding, latching and rotating block while releasing the firing spring.

13. The bolt action according to claim 9, wherein the marksman-side contact surface of the action casing-side control pin is beveled and includes an angle $\alpha$ with the longitudinal axis of the bolt action when viewed from above, ranging from 15° to 70°, and that the muzzle-side contact surfaces of the first control tooth and the second control tooth of each unit include an angle $\beta$ with the longitudinal axis of the bolt action when viewed from above that corresponds to angle $\alpha$, and also ranges from 15° to 70°.

14. The bolt action according to claim 9, wherein an inclined contact surface of the muzzle-side latching tooth of the muzzle-side end of the guiding, latching and rotating block includes an angle $\gamma$ with the longitudinal axis of the bolt action when viewed from above that ranges from 15° to 70°, and that marksman-side contact surfaces of the first control tooth and second control tooth of each unit includes an angle $\delta$ with the longitudinal axis of the bolt action when viewed from above that corresponds to angle $\gamma$, and also ranges from 15° to 70°.

15. The bolt action according to claim 6, wherein the first control tooth of each unit exhibits a shape that resembles a trapezoid or equilateral trapezoid when viewed from above wherein the base line of the trapezoid is aligned parallel to the longitudinal axis, and the opposing parallel side of the trapezoid is shorter than the base line, and that the second control tooth of each unit exhibits a triangular surface area when viewed from above, wherein one side of the triangle is aligned parallel to the longitudinal axis of the bolt action.

16. The bolt action according to claim 9, wherein the contact surfaces of the first control tooth and second control tooth along with the lateral borders of the through holes, in an effort to reduce the respective frictional surfaces, are outwardly projecting and back-cut with respect to an associated interior surface area on the outer periphery of the ring when viewed along the longitudinal axis.

17. The bolt action according to claim 9, wherein the contact surfaces of the first control tooth and second control tooth are straight or exhibit convex or concavely bent contours when viewed from above.

18. The bolt action according to claim 7, wherein the traversed movement path of the ring along the longitudinal axis while cocking and releasing the firing spring ranges from 5.0 mm to 30.0 mm.

19. The bolt action according to claim 8, wherein the width of the through holes of the row of control and latching teeth continuously provided on the outer circumference of the rotatable ring ranges from 4.0 mm to 15.0 mm, while the width of the latching notches ranges from 0.7 mm to 2.8 mm.

20. The bolt action according to claim 13, wherein the angle $\alpha$ is 30° to 50°, and wherein the angle is 30° to 50°.

21. The bolt action according to claim 14, wherein the angle $\gamma$ is 30° to 50°, and wherein the angle $\delta$ is 30° to 50°.

* * * * *